United States Patent [19]

Akae et al.

[11] Patent Number: 4,821,588

[45] Date of Patent: Apr. 18, 1989

[54] STARTER MOTOR

[75] Inventors: Yoshifumi Akae; Tatuo Yabe, both of Hyogo, Japan

[73] Assignee: Mitsubishi Denki Kabushiki Kaisha, Tokyo, Japan

[21] Appl. No.: 168,124

[22] PCT Filed: Jul. 11, 1987

[86] PCT No.: PCT/JP87/00496

§ 371 Date: Jan. 26, 1988

§ 102(e) Date: Jan. 26, 1988

[30] Foreign Application Priority Data

Jul. 15, 1986 [JP] Japan ..... 61-109023

[51] Int. Cl.[4] ..... F02N 15/06

[52] U.S. Cl. ..... 74/7 A; 74/7 R

[58] Field of Search ..... 74/6, 7 R, 7 A, 8, 9; 192/42

[56] References Cited

U.S. PATENT DOCUMENTS

| | | | |
|---|---|---|---|
| 1,487,686 | 3/1924 | Huntley | 74/9 |
| 1,720,962 | 7/1929 | MacBlane | 192/42 |
| 1,767,688 | 6/1930 | Meeder | 74/9 |
| 1,889,995 | 12/1932 | Meeder | 74/7 |
| 3,663,825 | 5/1972 | Bowcott | 290/38 |
| 3,798,977 | 3/1974 | Digby | 74/6 |
| 4,718,290 | 1/1988 | Murata et al. | 74/7 A |

FOREIGN PATENT DOCUMENTS

| | | | |
|---|---|---|---|
| 47-14496 | 5/1972 | Japan . | |
| 53-27762 | 3/1978 | Japan | 74/7 A |
| 54-19464 | 7/1979 | Japan . | |
| 56-9082 | 2/1981 | Japan . | |
| 58-23008 | 5/1983 | Japan . | |

*Primary Examiner*—Allan D. Herrmann
*Assistant Examiner*—Janice E. Chartoff
*Attorney, Agent, or Firm*—Sughrue, Mion, Zinn, Macpeak and Seas

[57] ABSTRACT

A starter motor includes axial protrusions 9*a* formed on an end face of a pinion 9 on the side of an engine starting gear 10 with which the pinion meshes to transmit rotation thereto, for breaking alien substances deposited around the pinion by rotation to thereby enable the pinion to mesh with the gear smoothly.

4 Claims, 2 Drawing Sheets

STARTER MOTOR

FIELD OF TECHNOLOGY

The present invention relates to a starter motor to be used in, for example, a starter of an automobile and, particularly, to a structure thereof for removing alien substances deposited in an interior of the motor.

BACKGROUND OF THE INVENTION

Japanese Model Publication No. 25561/1982 discloses a conventional starter motor of this type as shown in FIG. 1.

In the figure, a casing (1) is composed of a cylindrical yoke (2) and front and rear receivers (3) and (4) mounted on opposite ends of the yoke (2), respectively, and a field core (5) and a field winding (6) are mounted within the yoke (2). A rotary shaft (7) is rotatably supported by the front receiver (3) and the rear receiver (4) through respective bearings (3*a*) and (4*a*). An armature (8) is fixedly mounted on the rotary shaft (7) opposite the field core (5) with a predetermined space therebetween, and a pinion (9) for transmitting rotational force generated in the armature (8) to a starter gear (10) coupled to a drive shaft (not shown) of an engine and an over-running clutch (11) for transmitting the rotational force of the armature (8) to the pinion (9) unidirectionally are mounted on the rotary shaft axially slidably. One end of a lever (12) engages with a sleeve portion (11*a*) of the over-running clutch (11) and the other end of the lever (12) engages with a rod (13*a*) of an electromagnetic switch (13) mounted on the front receiver (3), so that, when the rod (13*a*) is moved leftwardly by the electromagnetic switch (13), the one end, i.e., the lower end of the lever (12) moves rightwardly with a point A as a fulcrum to apply rightward movements to the over-running clutch (11) and the pinion (9). The electromagnetic switch (13) is powered through a starter switch (not shown) of the engine to attract the rod (13*a*) leftwardly by an electromagnetic mechanism provided therein to thereby close contacts (not shown) provided therein so that electric power is supplied to the field winding (6) and the armature (8).

In the conventional starter motor as constructed above, when the starter switch is closed, the electromagnetic switch (13) is actuated to move the over-running clutch (11) and the pinion (9) rightwardly so that the pinion (9) meshes with gear (10). On the other hand, simultaneously with this operation, the contacts in the electromagnetic switch (13) are closed to power the field winding (6) and the armature (8), causing the armature (8) and the rotary shaft (7) to rotate unidirectionally as a unit. This rotational force is transmitted through the over-running clutch (11) to the pinion (9) and then to the gear (10) to start the engine.

In such conventional starter motor, when an automobile on which the starter is mounted is used in low temperature areas and if a sealing of a joint portion between the front receiver (3) and the engine is not adequate, the gear (10) which is possibly partially exposed may catch up ice and/or snow piled up on the ground while the engine is operating. Ice and/or snow caught up may fill a gap between the bearing portion (3*a*) of the front receiver (3) and the pinion (9), which may be frozen and solidified after the engine stops. Due to solidified ice and/or snow, the pinion (9) can not move rightwardly even if the starter switch is closed subsequently and the electromagnetic switch (13) is actuated thereby, and thus the pinion (9) can not mesh with the gear (10). In such case, the contacts in the electromagnetic switch (13) are closed to rotate the armature (8). However, the pinion (9) merely rotates in a slip engagement between an end face thereof and solidified ice, without transmission of rotational force to the gear (10). That is, with such conventional starter motor, the pinion (9) can not mesh with the gear (10) due to solidified ice deposited between the bearing portion (3*a*) of the front receiver (3) and the pinion (9), resulting in an impossibility of engine starting.

The present invention overcomes such problem by providing a starter motor capable of removing solidified ice and/or snow deposited in the front receiver by rotation of the pinion.

SUMMARY OF THE INVENTION

The present invention resides in the provision of axial protrusions formed on an end face of a pinion for transmission of rotational force of an armature to an engine, which faces to the gear of the engine. With such protrusions, alien substances solidified around the pinion can be broken and removed by rotation of the pinion.

PREFERRED EMBODIMENTS FOR PRACTICING THE INVENTION

Figure 1:
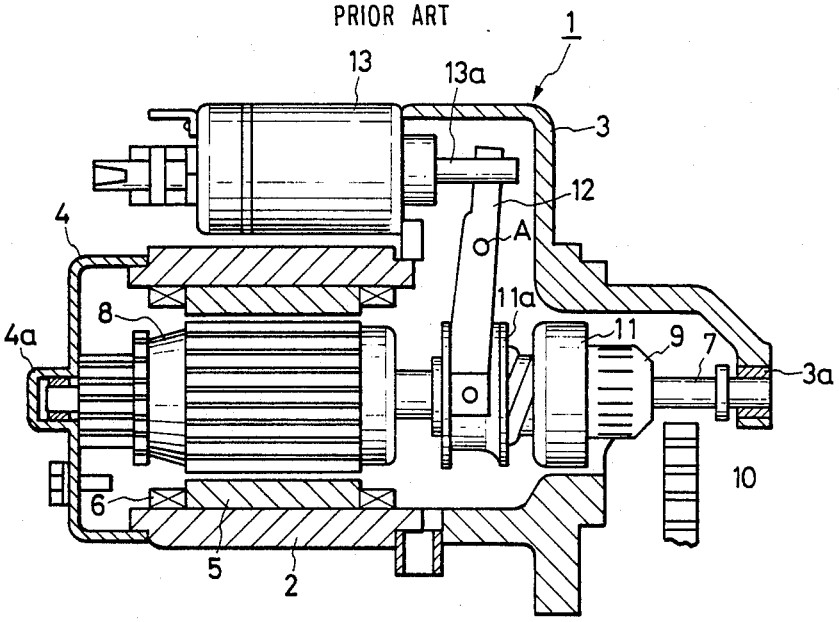
FIG. 1 PRIOR ART
FIG. 1 is a cross section showing a conventional starter motor.
Figure 3:
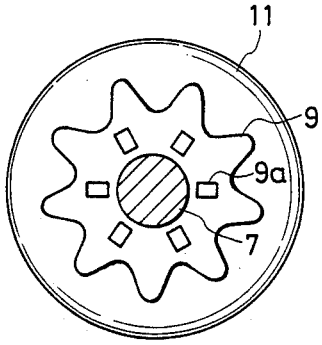
FIG. 3 is a cross section taken along line III—III in FIG. 2.
Figure 2:
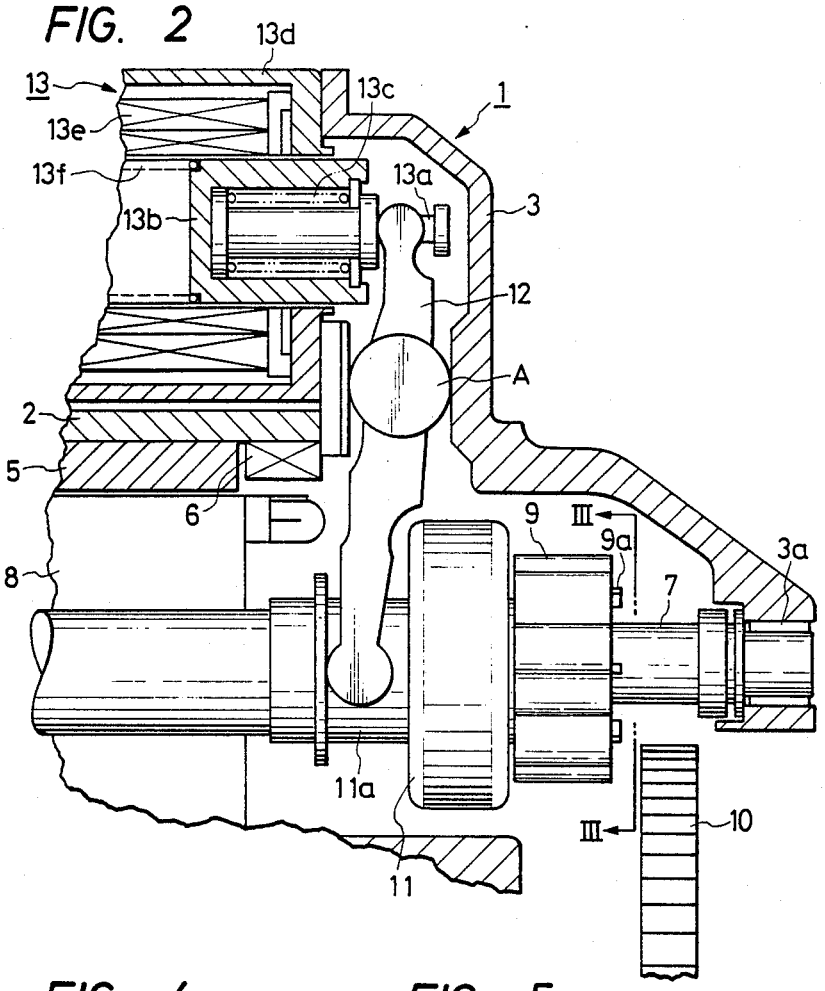
FIG. 2 is a partial cross section showing a starter motor according to an embodiment of the present invention.

In FIG. 2, an electromagnetic switch (13) is composed of a cylindrical plunger (13*b*) having one end closed, for axially slidably supporting a rod (13*a*), a spring (13*c*) for biasing the rod (13*a*) unidirectionally with respect to the plunger (13*b*), a casing (13*d*) for axially slidably supporting the plunger (13*b*), a magnetizing coil (13*e*) housed in the casing (13*d*) for axially sliding the plunger (13*b*), a return spring (13*f*) for returning the plunger (13*b*) to a predetermined position, and switch contacts (not shown) adapted to be opened by the plunger (13*b*), etc. The pinion (9) is formed on an end face thereof facing to a gear (10) with a plurality of protrusions (9*a*) which are arranged on a circle coaxial with a rotary shaft (7) as shown in FIG. 3, with an outer periphery defined by the protrusions being smaller than a dedendum circle of the pinion (9). Since other constructions than that mentioned above are substantially the same as those shown in FIG. 1, they are depicted by the same reference numerals, respectively, without any details thereof.

With such construction, it is possible under a normal use condition to start the engine by meshing the pinion (9) with the gear (10) in the same manner as described with reference to FIG. 1. In this case, the protrusions (9*a*) formed on the pinion (9) which do not protrude outwardly beyond the dedendum circle of the pinion (9) do not contact the teeth of the gear (10) and so they do not damage the gear (10).

In a case where solid state ice and/or snow fills the space between the bearing (3*a*) of the front receiver (3) and the pinion (9), when the starter switch is closed and the magnetizing coil (13*e*) is supplied with electric current thereby, the plunger (13*b*) is attracted leftwardly in the drawing. However, since the movement of the pinion (9) and the over-running clutch (11) is blocked initially by the solid ice, the rod (13*a*) is stopped after its leftward movement by a distance corresponding to a mounting tolerance of the lever (12). On the other hand, the plunger (13*b*) continues to move leftwardly while compressing the spring (13*c*) to thereby close the contacts (not shown) so that the armature (8) and the field winding (6) are fed. Therefore, the armature (8) is rotated and thus the pinion (9) is rotated. Thus, the solid ice can be broken by the protrusions (9*a*) formed on the end face of the pinion (9) and rotating therewith. In this case, since the rod (13*a*) is urged by the spring (13*c*), the pinion (9) is urged rightwardly by the pressure of the spring so that the front end of the pinion (9) always contacts new portions of the solid ice to break it sequentially.

That is, the rotating pinion (9) moves rightwardly while breaking the solid ice. As a result, it becomes easy to mesh the pinion (9) with the gear (10) and to thereby start the engine smoothly.

Figure 4:
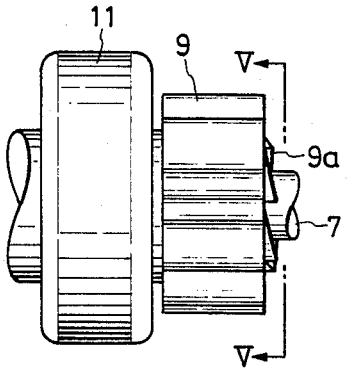
FIG. 4 is a side view of a main portion of another embodiment of the present invention.
Figure 5:
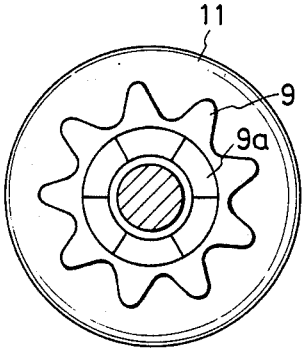
FIG. 5 is cross section taken along a line V—V in FIG. 4.

FIGS. 4 and 5 show another embodiment of the present invention, in which each protrusion (9*a*) takes in the form of wedge. With such protrusions (9*a*), it is possible to break the solid ice with an improved durability of the protrusions against shocks encountered when they break the ice.

Although, in the described embodiments, the pinion (9) is brought into meshing relation to the gear (10) by moving the lever (12) by means of electromagnetic power of the electromagnetic switch (13), i.e., by the so-called electromagnetic push-in type mechanism, it is needless to say that this origination can be applied to other systems.

Similar operation and effect can be expected for alien substances other than ice and/or snow, which fills the space.

As described hereinbefore, according to the present invention, it is possible to remove alien substances deposited around the pinion by such simple construction as formation of axial protrusions on an end face of the pinion which face a gear and break the alien substance, to make meshing of the pinion with the gear reliable and to make a start of engine smooth.

We claim:

1. A starter motor, comprising: a rotary shaft (7) rotatably supported by a casing (1), an armature (8) for rotationally driving said shaft, a pinion (9) slidably mounted on said shaft and axially movable thereon to transmit rotation of said shaft to an engine by meshing with an engine starting gear (10), an electromagnetic switch (13) for axially sliding said pinion to mesh with said engine starting gear and for simultaneously supplying electric current to said armature to rotate said shaft and pinion, and means for removing any foreign material, such as ice, mud or packed snow, blocking a path of axial travel of the rotating pinion into meshed engagement with the starting gear, said removing means comprising a plurality of protrusions formed on an end face of said pinion, facing said starting gear, and extending axially outwardly from said end face.

2. The starter motor as claimed in claim 1, wherein a circle defined by the rotation of said protrusions is smaller than a dedendum circle of said pinion.

3. The starter motor as claimed in claim 2, wherein said protrusions are arranged radially of a center of said rotary shaft.

4. The starter motor as claimed in claim 2, wherein said protrusions comprise wedge members having amounts of axial extension varying along a direction of rotation.

* * * * *